US005507450A

United States Patent [19]

Hoar

[11] Patent Number: 5,507,450

[45] Date of Patent: Apr. 16, 1996

[54] APPARATUS FOR THE WINDING OF CONTINUOUS WEBS

[75] Inventor: Jack E. Hoar, Bury, United Kingdom

[73] Assignee: Warburton Holgate Limited, Manchester, United Kingdom

[21] Appl. No.: 211,573

[22] PCT Filed: Oct. 12, 1992

[86] PCT No.: PCT/GB92/01862

§ 371 Date: Jul. 1, 1994

§ 102(e) Date: Jul. 1, 1994

[87] PCT Pub. No.: WO93/08109

PCT Pub. Date: Apr. 29, 1993

[30] Foreign Application Priority Data

Oct. 12, 1991 [GB] United Kingdom ..... 9121692

[51] Int. Cl.[6] ..... B65H 35/04

[52] U.S. Cl. ..... 242/527.3

[58] Field of Search ..... 242/526, 527.3, 242/533.2, 542, 542.3

[56] References Cited

U.S. PATENT DOCUMENTS

| | | | |
|---|---|---|---|
| 2,802,586 | 8/1957 | Wingard | 242/533.2 |
| 2,989,262 | 6/1961 | Hornbostel | 242/527.3 |
| 3,061,221 | 10/1962 | Aulen | 242/542.3 |
| 3,062,465 | 11/1962 | Hunter | 242/527.3 |
| 3,162,393 | 12/1964 | Gelleke | 242/526 |
| 3,345,010 | 10/1967 | Egan | 242/66 |
| 3,718,300 | 2/1973 | Aronoff | 242/533.2 |
| 3,918,654 | 11/1975 | Okubo et al. | 252/533.2 |
| 4,304,368 | 12/1981 | Bartmann | 242/526 |
| 4,370,193 | 1/1983 | Knauthe | 424/533.2 |
| 4,408,727 | 10/1983 | Dropczynski | 242/533.2 |
| 4,444,360 | 4/1984 | Kaipf et al. | 242/526 |
| 4,572,451 | 2/1986 | Ikeda et al. | 242/527.3 |
| 4,988,051 | 1/1991 | Welschiau et al. | 242/542.3 |

FOREIGN PATENT DOCUMENTS

| | | |
|---|---|---|
| 1200636 | 9/1965 | Germany . |
| 4039048 | 6/1992 | Germany . |
| 278083 | 10/1927 | United Kingdom . |

*Primary Examiner*—Daniel P. Stodola
*Assistant Examiner*—Emmanuel M. Marcelo
*Attorney, Agent, or Firm*—Duane, Morris & Heckscher

[57] ABSTRACT

Reel winding apparatus comprises two spaced side-by-side support drums (12, 13) and a pivotal carriage (14) which act to support a roll (11) whilst material (16) is being wound thereonto. A transfer device acts to support a prepared roll core (21) and to deliver the core (21) to the support drums (12, 13) when the roll (11) has reached its requisite size. Pressure loading roller (19) maintains the roll (11) and the roll core (21) respectively in contact with at least one of the support drums (12, 13). In use, material is wound onto roll (11) until the roll (11) has reached its requisite size. The carriage (14) is then pivoted to move the reel (11) out of contact with the upstream drum (12) and the prepared reel core (21) is moved into a ready position above the upstream drum (12). A splicing blade (22) cuts the material (16) being fed to the roll (11) and then the leading edge of the cut web (16) wraps about the prepared core (21) and engages double sided adhesive tape thereon. The carriage (14) pivots further and the full roll (11) is released for unloading. Roll core (21) is moved into engagement with the support drums (12, 13) and a new reel core is readied for introduction. The carriage (14) is returned to its vertical position.

5 Claims, 2 Drawing Sheets

APPARATUS FOR THE WINDING OF CONTINUOUS WEBS

The invention concerns the winding of continuous webs, and has more particular reference to an apparatus which will allow the automatic unloading of a full reel and the introduction of a prepared reel core in lieu thereof.

According to the present invention there is proposed a reel winding apparatus comprising spaced side-by-side support drums, a support gantry engageable with a roll core supported on and between said drums, a transfer means adapted to support at least one prepared replacement roll core and to deliver said core to the drums for support thereby, pressure loading means engageable with the core or material wound thereon and adapted to urge said core or material into engagement with one at least of said drums, and splice cutting means positioned between the drums and adapted for cooperative engagement with a web passing between said drums, the support gantry being engageable with a web roll on said drums and being pivotal to unload said roll therefrom, said web being urged into splicing engagement with said cutting means by movement of a replacement core towards the support drums.

According to a preferred feature the support gantry includes a carriage freely movable relative thereto and the carriage including actuable hook means engageable with a roll core.

According to a further preferred feature the carriage is movable relative to the support gantry by rack and pinion means operable against a toothed reaction plate, the extent of movement of the carriage being determined by a combination of the rotational and translational motion of the pinion.

According to a still further preferred feature, the transfer means includes a pivoted cam lever to receive a roll core and movable hook means engageable with a roll core supported on said lever to locate the core relative to a support drum.

Figure 1A:
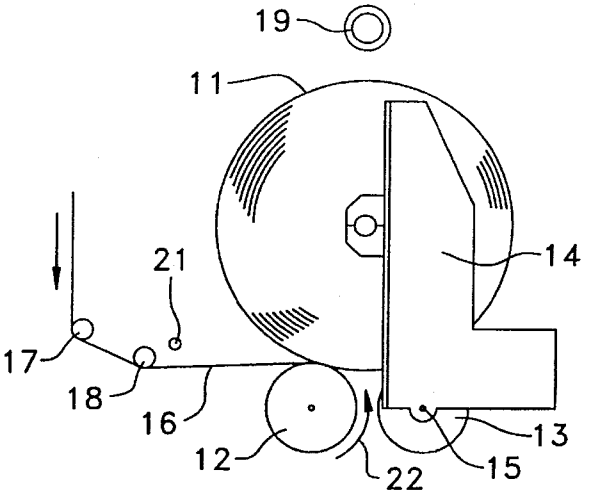
Figure 1B:
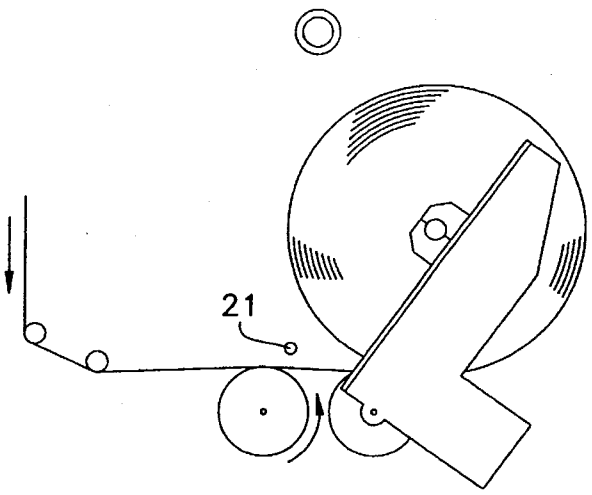
Figure 1C:
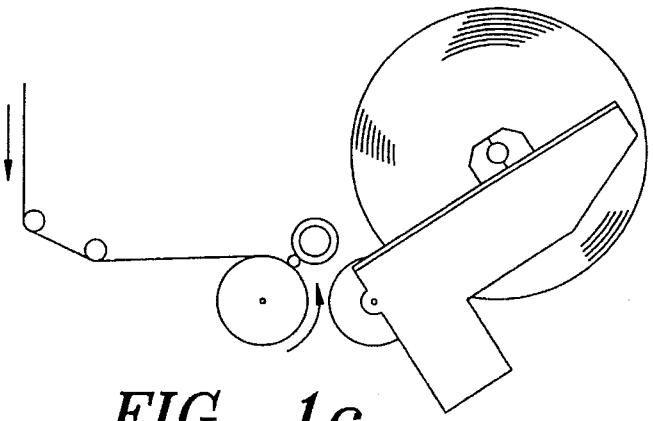
Figure 1D:
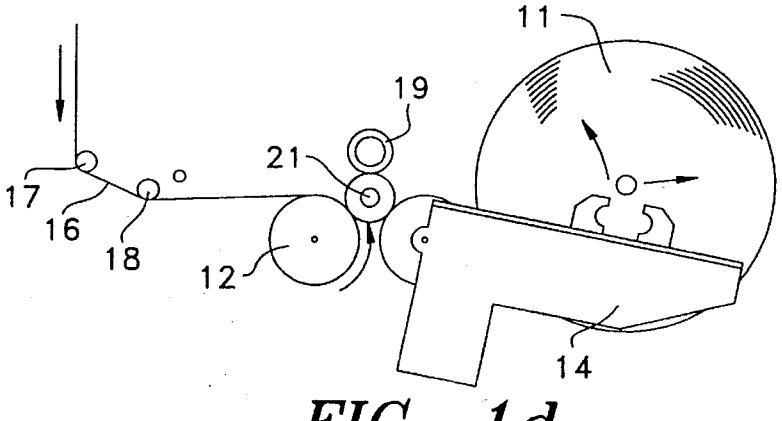
Figure 2:
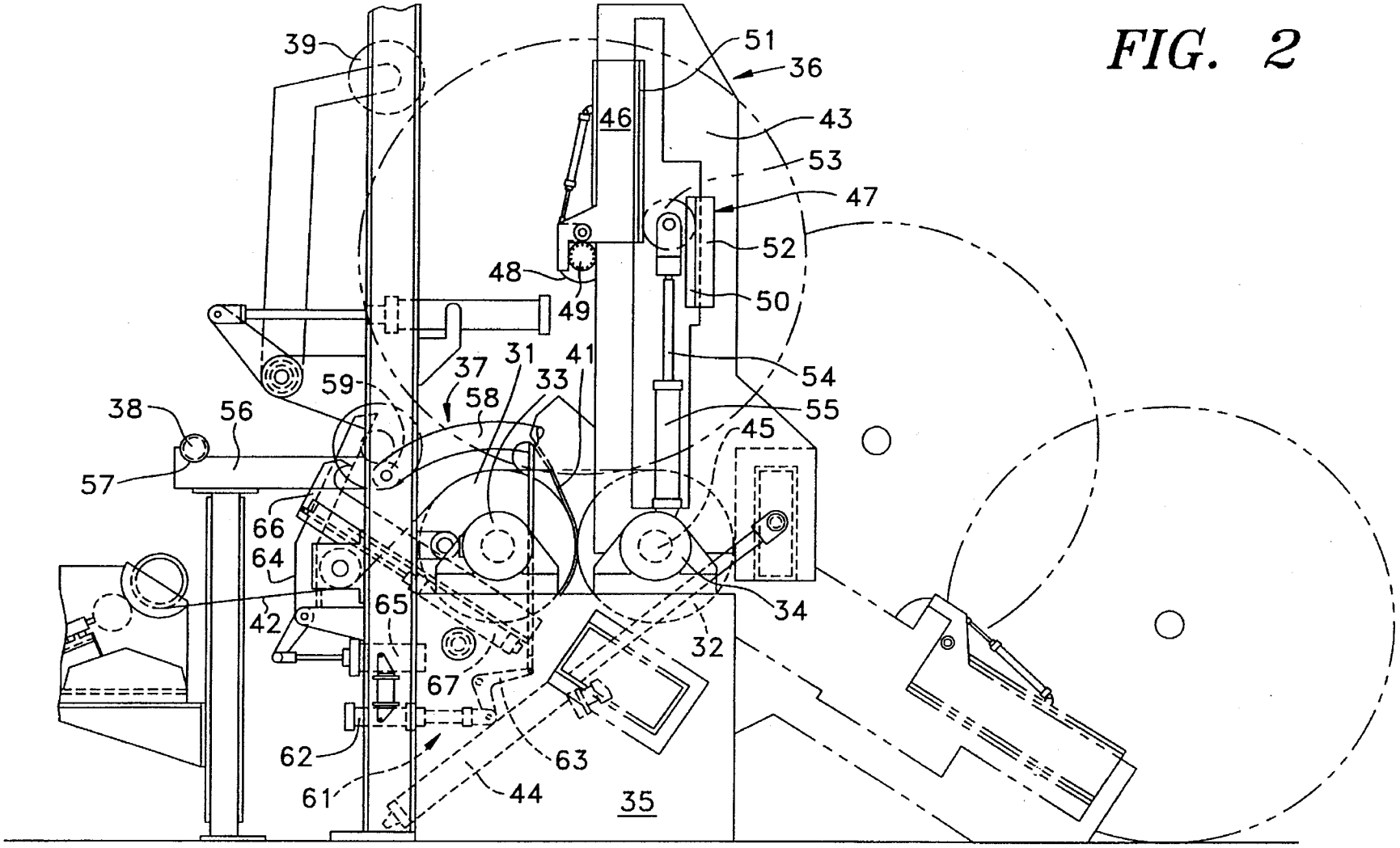

The invention will now be described further, by way of example only, with reference to the accompanying drawings illustrating one embodiment thereof and in which:

FIGS. 1*a* to 1*d* show, in diagrammatic manner, the successive stages in winding continuous web material and shows the introduction of a new core and the unloading of a wound reel; and FIG. 2 is a front elevation of winding apparatus constructed in accordance with the invention.

Referring firstly to FIGS. 1*a* to 1*d*, FIG. 1*a* shows a full reel 11 supported on driven support drums 12, 13 and ready for unload, the weight of the reel being supported in part by a main reel carriage 14 mounted for pivotal motion about the rotational axis 15 of the downstream support drum 13. The web 16 being wound is drawn from a continuous supply thereof, not shown, and passes around fixed guide rollers 17, 18 and over the upstream support drum 12.

A riding roll 19, intended for pressure contact with the reel during initial reel build up, is in a retracted position above the full reel 11 and a prepared reel core 21 is positioned for movement into engagement with the upstream support drum 12 on displacement of the full reel 11 from downstream support drum 13.

A splicing blade 22 is provided between support rolls 12, 13 and is movable from the retracted position shown in FIG. 1*a* into operative cutting relationship with the web 16, as will hereafter become apparent.

In the arrangement of parts shown in FIG. 1*a* both of the support drums 12, 13 are being driven.

Once the reel 11 has attained its requisite size the main reel carriage 14 is pivotted to move the reel out of contact with the upstream support drum 12, the prepared reel core 21 is moved to a position above drum 13, and the splicing blade 22 is moved to a ready position immediately below the web 16. This relative disposition of parts is shown in FIG. 1*b*.

On further movement of the reel core 21 towards the downstream support drum 13, the web 16 is displaced so as to engage splicing blade 22, the leading edge of the cut web wrapping about the reel core 21 to engage a double-sided adhesive tape thereon and such core being loaded into pressure contact with drum 12.

The splicing blade 22 is now retracted, the downstream support drum 13 is braked and the main reel carriage 14 continues its pivotal motion to remove the full reel from support drum 13 and releases such reel for unloading. The reel core 21 is now moved into engagement with both of the support drums 12, 13, the downstream drum again being in drive mode, and a new reel core (not shown) is readied for introduction.

These further stages are shown in FIGS. 1*c* and 1*d*.

Finally the main reel carriage 14 is returned to its vertical position as shown in FIG. 1*a*.

As will readily be appreciated, the apparatus as shown diagrammatically in FIGS. 1*a* to 1*d* will allow the continuous winding of web material without interruption of winding for core replacement. The cores can be prepared in advance and applied automatically to the winding machine as winding of a reel is completed, and the full reel is unloaded.

The facility for applying pressure to the prepared reel core 21 on initial engagement with the upstream support drum 12 and during initial reel build-up and for partial support of the reel 21 by the main reel carriage 14 in the later stages of such build-up ensures uniformity of winding.

Referring now to FIG. 2, which illustrates one embodiment of the invention in front elevation, a twin-drum surface rewind machine comprises two support drums 31, 32 mounted in spaced side-by-side disposition in journals 33, 34 provided on a machine frame 35, a main reel gantry 36 mounted for pivotal motion about the axis of the downstream one of the drums, a transfer means 37 at the upstream side of the rollers and serving to move prepared reel cores successively to the support drums 31, 32, a riding roll 39 movable between operative and inoperative positions with respect to the support drums, and a splice and cutting means operable on a web moving between and in contact with the drums.

The main reel gantry 36 comprises an upstanding arm 43 pivotted at its lower end for movement about the rotational axis of support drum 32 and a main piston and cylinder arrangement 44 for effecting such movement, the piston and cylinder arrangement 44 being secured to the lower end of the arm 43 at a position in offset disposition with respect to the pivot axis 45 thereof and extending between such arm and the machine frame 35. The gantry 36 further includes a carriage 46 slidably on the arm 43 and adjustment means 47 for controlling such sliding movement, the carriage supporting a releasable hook 48 engageable with the end of the core reel 49. The adjustment means 47 for the carriage 46 includes a rack 51 secured to said carriage 46, a toothed reaction plate 52 fixedly mounted on the arm 43 in spaced disposition with respect to the rack 51, a compound pinion 53 having respective parts thereof in engagement with and between the rack 51 and teeth 50 on plate 52, and a piston and cylinder means 53, 55 supporting the pinion 54 for movement relative to the toothed plate 52. Upon movement of the piston 54 axially of its cylinder 55 the pinion 53 is moved longitudinally of the plate 52 and is rotated by virtue of the engagement of such pinion with the teeth provided thereon, such rotational movement effecting a sliding movement of the carriage 46 relative to the guide defined on and by the arm, the extent of movement being a composite of the translational and rotational movement of the pinion 53 and related also to the gear ratio between the parts of the compound gear. In the present instance this ratio is preferably 2:1.

The transfer means 37 includes a stand 56 having a first recess 57 thereon to support a prepared reel core 38, the stand 56 having a cam lever 58 pivotally connected to the remote end thereof, a second recess 59 in alignement with the pivot axis of the cam lever 58 and actuator means 61 operable on the cam lever 58 to effect pivotal motion thereof, the actuator means 61 comprising a piston and cylinder arrangement 62 secured to the machine frame 35 and operable to control the position of the cam lever 58 through a linkage 63.

The transfer means 37 further includes a displacement lever 64 pivotally mounted on the machine frame 35 and positionally controlled by a displacement cylinder 65, the lever 64 being cooperable with a prepared reel core on the stand 56 so as, upon adjustment, to move the core 38 from the first recess 57 to the second recess 59.

Movement from recess 59 along the cam 58 is effected by a chain drive means, not shown.

A further lever 66 is pivotted on the machine frame 35, said lever 66 having a hooked end thereto for engagement with a mandrel coaxial with the core, there being piston and cylinder means 67 for effecting movement of the said lever 66 longitudinally of the cam lever 58 from the second recess 59 to a position above and adjacent the upstream support drum 31 and thereafter to apply a loading to the core during initial building-up. On progressive reel build up the hooked end to lever 66 is withdrawn from the mandrel and pressure is thereafter applied by riding roll 39. Also with progressive reel build-up the carriage 46 operates to support the reel and thereby maintain sensibly uniformity of winding.

The operation of the structure as shown in FIG. 2 is analogous to that described in relation to FIGS. 1*a* to 1*d* and no further description is thought necessary.

The arrangement as hereinproposed has been found to provide a means for the winding of a continuous web in a ready manner. By suitable timing of the operation of the various instrumentalities it is possible for the winding operation to be automatic. The splice and cutting mechanism avoids the formation of a tail on the wound drum, whilst the provision of a weight relief facility on the gantry by means of the carriage provided thereon and the possibility of loading the reel core into engagement with the support drum or drums does ensure uniformity of winding through the full reel build-up.

The apparatus has been found to be eminently suitable for winding heavy/high strength webs.

I claim:

1. A reel winding apparatus for winding a web material onto prepared roll cores comprising spaced side-by-side support drums supporting a first prepared roll core as the material web is wound thereon, a support gantry engageable with said first prepared roll core at least when it is supported on and between said drums and being pivotal to unload said first prepared roll core from said support drums once a predetermined amount of web material has been wound thereon, transfer means for delivering a second prepared roll core to the support drums, pressure loading means engageable with at least the second prepared roll core and adapted to urge said second prepared roll core against said web material and into engagement with at least a first of said drums, splice cutting means positioned between the drums and adapted for cooperative operation with said pressure loading means upon said delivery of said second prepared roll core whereby said pressure loading means depresses said web material into said splice cutting means to simultaneously sever said web material while permitting the splicing of a remaining free end of said web material onto said second prepared roll core.

2. Apparatus according to claim 1, wherein the support gantry further includes a carriage mounted thereon to be freely movable relative thereto and the carriage includes an actuable hook means for engaging said first prepared roll core.

3. Apparatus according to claim 2, wherein the carriage is movable relative to the support gantry by a rack and pinion arrangement, the extent of movement of the carriage being determined by a combination of the rotational and translational motion of a pinion in said rack and pinion arrangement.

4. Apparatus according to claim 1, characterised in that said transfer means includes a pivoted cam lever to receive a roll core and movable hook means engageable with a roll core supported on said lever to locate the core relative to a support drum.

5. A reel winding apparatus for winding a web material onto adhesively-prepared roll cores comprising spaced side-by-side support drums supporting a first adhesively prepared roll core as the material web is wound thereon; transfer means adapted to support said first adhesively-prepared roll core and to deliver a second adhesively-prepared roll core to said support drums; pressure loading means engageable with the second adhesively-prepared roll core and adapted to urge said second adhesively-prepared roll core against said web material and into engagement with said drums; splice cutting means positioned between said drums for severing said web material upon the delivery of said second adhesively-prepared roll core to said support drums, said pressure loading means compressing said adhesively-prepared roll core into said web material to depress said web material against said splice cutting means for cutting said web material and simultaneously adhere a free end of said web material to said second adhesively-prepared roll core; and a support gantry engageable to lift said first adhesively-prepared roll core from a first of said drums while permitting engagement with a second of said drums during the severing of said web material by said splice cutting means.

* * * * *